US006886539B2

(12) United States Patent
Perras

(10) Patent No.: US 6,886,539 B2
(45) Date of Patent: May 3, 2005

(54) DEVICE FOR FIXING INJECTORS ON A CYLINDER HEAD

(75) Inventor: Alwin Perras, Breitenbrunn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/802,022

(22) Filed: Mar. 16, 2004

(65) Prior Publication Data

US 2004/0173186 A1 Sep. 9, 2004

Related U.S. Application Data

(63) Continuation of application No. PCT/DE02/03456, filed on Sep. 16, 2002.

(30) Foreign Application Priority Data

Sep. 18, 2001 (DE) ..... 101 45 988

(51) Int. Cl.[7] ..... F02M 55/02
(52) U.S. Cl. ..... 123/470
(58) Field of Search ..... 123/470, 463, 123/446, 467, 468, 469, 472; 239/533.2

(56) References Cited

U.S. PATENT DOCUMENTS 1,948,557 A 2/1934 Baur ..... 299/107.1
4,984,549 A * 1/1991 Mesenich ..... 123/472
5,630,400 A * 5/1997 Sumida et al. ..... 123/470
5,943,995 A * 8/1999 Niwa et al. ..... 123/470

FOREIGN PATENT DOCUMENTS

| | | | |
|---|---|---|---|
| DE | 3908796 A1 | 12/1989 | ..... F02M/61/14 |
| DE | 4315233 A1 | 7/1994 | ..... F02M/61/14 |
| DE | 19508305 A1 | 9/1996 | ..... F02M/61/14 |
| DE | 19511703 A1 | 10/1996 | ..... F02M/61/14 |
| EP | 0819846 A1 | 1/1998 | ..... F02M/61/14 |
| GB | 565793 | 11/1944 | |
| JP | 09088765 | 3/1997 | ..... F02M/6/14 |

OTHER PUBLICATIONS

PCT International Search Report Application No. PCT/DE02/03456, 6 pages, mailed Sep. 3, 2003.

* cited by examiner

*Primary Examiner*—Mahmoud Gimie
(74) *Attorney, Agent, or Firm*—Baker Botts L.L.P.

(57) ABSTRACT

The invention concerns a fixing device for fixing an injector on a cylinder head. Said injector comprises several axially successive modules pressed against one another by means of a prestressing element. A fixing force for fixing the injector is applied on the prestressing element to counter the influence of opposite forces applied on the injector modules.

20 Claims, 3 Drawing Sheets

DEVICE FOR FIXING INJECTORS ON A CYLINDER HEAD

CROSS-REFERENCE TO RELATED APPLICATION

This application is a continuation of co-pending International Application No. PCT/DE02/03456 filed Sep. 16, 2002 which designates the United States, and claims priority to German application number DE10145988.2 filed Sep. 18, 2001.

TECHNICAL FIELD OF THE INVENTION

The present invention relates to a fixing arrangement for mounting an injector on a cylinder head.

BACKGROUND OF THE INVENTION

FIG. 4 shows a fixing arrangement for mounting an injector on a cylinder head according to the prior art. In this arrangement the injector 1 consists, as is known, of a plurality of injector modules 7, 2, 3 which are disposed successively in the axial direction M—M of the injector. The main components of the injector here are an injector body 7, a stop disk 2, an injection nozzle 3 and a nozzle tensioning nut 4 which braces the injector modules 7, 2, 3 against one another. In so doing the nozzle tensioning nut 4 exerts a predefined axial force $F_V$. Here, the axial force $F_V$ is dimensioned such that it provides a sealing function at the interfaces between the individual injector modules and also such that any distortion or stress in the interior of the injector modules does not exceed a predetermined level in order to prevent damage to the components. The injector 1 pretensioned in this way is sealed via a sealing washer 5 on the cylinder head 6. The force F necessary to achieve the sealing effect is applied here directly onto the injector body 1. In order to prevent damage to the components of the injector 1 as a result, this fixing force F must be limited. However, this also limits the sealing effect between the cylinder head 6 and the injector 1. As a consequence unwanted escapes and leakages can occur between the cylinder head 6 and the injector 1.

SUMMARY OF THE INVENTION

The object of the present invention is therefore to provide a fixing arrangement for mounting an injector on a cylinder head which, at the same time as being simple in structure and easy and inexpensive to manufacture, permits improved sealing between the cylinder head and the injector.

This object is achieved by a fixing arrangement with the following features according to one embodiment of the invention: bracing the injector modules of an injector against one another via a pretensioning element, and applying a direct or indirect fixing force to the pretensioning element for mounting the injector to the cylinder head.

The fixing arrangement according to the invention for mounting the injector on the cylinder head is designed in such a way that a fixing force for mounting the injector is applied directly or indirectly to the pretensioning element of the injector. By this means the fixing force can be prevented from acting directly on the injector modules. In this way it is possible to employ a higher fixing force than is used in the prior art, thereby resulting in improved sealing between the cylinder head and the injector. As the fixing force is no longer applied directly to the injector modules, damage to the injector modules can also be reliably prevented. By introducing the force onto the pretensioning element of the injector, the fixing force can thus be used fully for the sealing function.

According to a particularly advantageous embodiment of the present invention, the fixing force is preferably applied in the direction in which the force is introduced, at a position which is located after a first bracing contact between the pretensioning element and the injector modules. In this way it is ensured that the fixing force is directed in its entirety past the injector modules, since the force is applied in the direction of introduction of the force at the nozzle tensioning nut only after the first bracing contact. Above all this can be used to exploit the fact that the pretensioning element of the injector is not completely rigid, but exhibits a certain flexibility. Thanks to the advantageously chosen position of the force introduction, this flexibility can be exploited according to the invention to ensure that there are no resulting additional effects on the injector modules braced by the pretensioning element.

In order to enable the fixing force to be directed easily past the electric modules, the fixing force is preferably introduced via an additional sleeve-like component. It is particularly preferred in this case if the sleeve-like component acts on a collar embodied on the pretensioning element. By this means the fixing force is transmitted via the sleeve-like component and the collar of the pretensioning element directly onto the cylinder head. It should be noted that another sealing disk can be disposed between the pretensioning element and the cylinder head in order to provide a better sealing function.

In order to ensure that the fixing force has no effects on the injector modules, the collar is disposed at a lower end area of the pretensioning element. This means that the flexibility of the pretensioning element can be exploited down the entire length of the pretensioning element in order to prevent an application of force onto the other components of the injector.

According to another preferred embodiment of the present invention, a ring-shaped element is disposed between the pretensioning element and the sleeve-like component. In order to keep a radial component of the fixing force applied to the pretensioning element as small as possible in this case, the ring-shaped element preferably has a circular or oval cross-section. The ring-shaped element can be embodied for example as an embossing ring or as a slotted ring.

According to a preferred embodiment of the present invention, the ring-shaped element is embodied as a nut which is screwed onto an external thread on the pretensioning element. The fixing force can then be applied to the pretensioning element via the nut. When a sleeve-like component is used, the use of the nut has the advantage compared with the embodiment of a collar on the pretensioning element that the sleeve-like component can also be inserted only once the injector has been assembled. When a collar is used, the sleeve-like component has already to be inserted before the final assembly of the injector, since after the final assembly of the injector it is not possible to insert the sleeve-like component from the side opposite the collar, since of course there are typically projecting components on the injector for, for example, electrical terminals or fuel supply lines. The use of the nut thus has assembly-related advantages. In this case the external thread for fixing the nut is preferably disposed at a position of the pretensioning element which is located in the direction of introduction of the force at a position after the first bracing contact of the pretensioning element with the injector modules. It is particularly preferred if the external thread is disposed at the lower end area of the pretensioning element.

In order to allow a simple design of the injector and the fixing arrangement, the pretensioning element is preferably embodied as a nozzle tensioning nut. In this case a first bracing contact is advantageously provided via a thread and a second bracing contact by means of a shoulder on the nozzle tensioning nut.

The fixing force is preferably applied to the pretensioning element by means of a claw fixed to the cylinder head. In this case the claw can for example be screwed onto the cylinder head or calked or fixed in any other way.

By means of the inventive introduction of the fixing force via the pretensioning element of the injector, higher axial forces can therefore be implemented for providing a seal between the injector and the cylinder head than is possible in the prior art. Particularly advantageous here is the introduction of the fixing force onto the pretensioning element after a first bracing contact in order to rule out completely any application of force onto components of the injector. A certain flexibility of the pretensioning element can be exploited here. If the first bracing contact is additionally embodied in the form of a thread, the usable flexibility can be further increased, since the thread further reduces a rigid behavior of the pretensioning element. This applies in the same way if a nut is provided on the pretensioning element, via which nut the fixing force is introduced.

BRIEF DESCRIPTION OF THE DRAWINGS

The invention will be described in the following with reference to preferred exemplary embodiments in connection with the drawing, in which.

DETAILED DESCRIPTION OF THE PREFERRED EMBODIMENTS OF THE INVENTION

Figure 1:
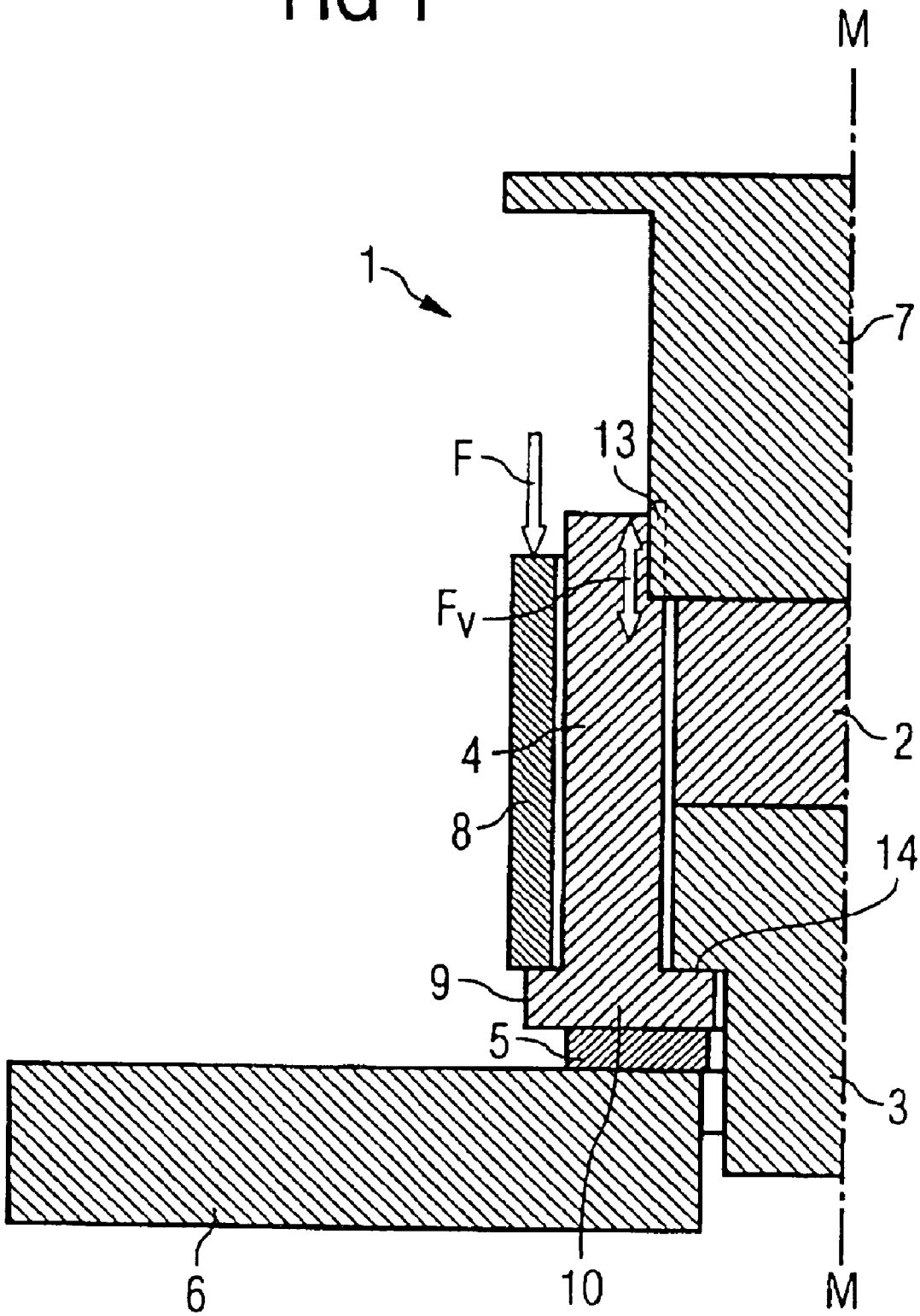
FIG. 1 shows a schematic sectional view of a fixing arrangement according to a first exemplary embodiment of the present invention.

FIG. 1 shows a fixing arrangement for mounting an injector 1 onto a cylinder head 6 according to a first exemplary embodiment.

The injector 1 consists of a plurality of injector modules 7, 2, 3 which are disposed in sequence in the axial direction. More precisely, the injector modules are embodied as injector body 7, stop disk 2 and injection nozzle 3. The injector modules 7, 2, 3 are braced against one another in the known manner by means of a nozzle tensioning nut 4, whereby a first bracing contact 13 is embodied at the nozzle tensioning nut 4 and a second bracing contact 14 is embodied toward the injector modules. The first bracing contact 13 is embodied here as a thread and the second bracing contact 14 is embodied as a shoulder in the nozzle tensioning nut 4.

The bracing of the injector modules is now accomplished simply by screwing the nozzle tensioning nut onto the thread 13. This produces an axial force $F_V$ for bracing which is dimensioned such that the sealing function is fulfilled between the interfaces of the individual injector modules and also such that no distortion of or excessive stress to the individual injector modules occurs.

The fixing arrangement for mounting the injector 1 on the cylinder head 6 now consists mainly of a sleeve 8 which is in contact with a collar 9 embodied on the nozzle tensioning nut 4. In this case the collar 9 is formed at a lower end area 10 on the exterior face of the nozzle tensioning nut 4. According to the invention the fixing force F is now introduced onto the sleeve 8 so that the force is applied onto the cylinder head 6 via the sleeve 8, the collar 9 and a sealing washer 5 disposed between the nozzle tensioning nut 4 and the cylinder head 6. As a result the fixing force F is applied in the direction of introduction of the force (as shown in FIG. 1, downward in the direction of the arrow F) at a position which is located in the direction of introduction of the force after the first bracing contact 13 (cf. FIG. 1).

Figure 4:
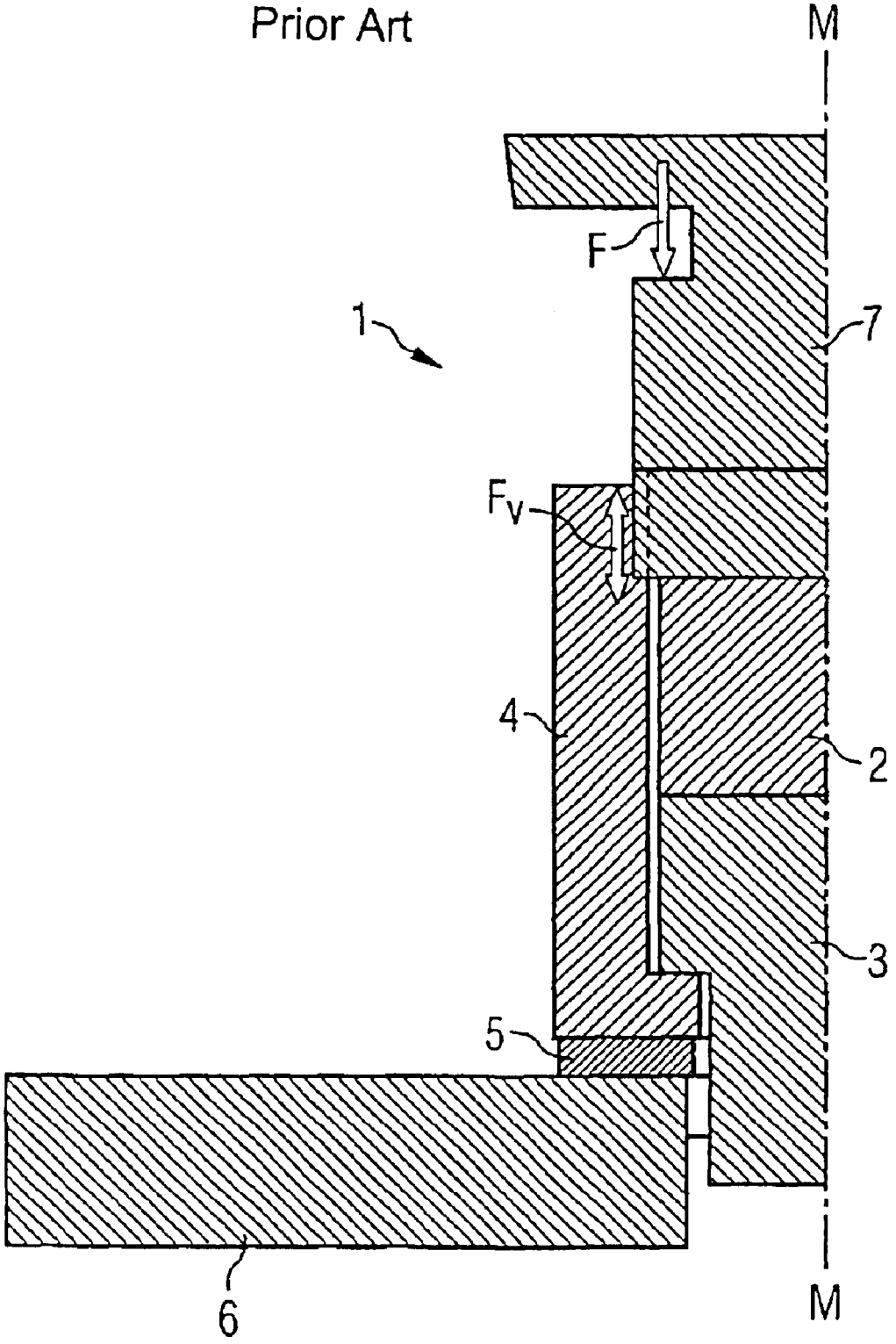
FIG 4 Prior Art
FIG. 4 shows a schematic sectional view of a fixing arrangement according to the prior art.

Since the nozzle tensioning nut 4 is not a completely rigid component but exhibits a certain flexibility, albeit also only to a limited degree, it can be achieved by applying the force after the bracing contact 13 that the fixing force F has no negative effects on the individual injector modules 7, 2, 3. Accordingly it is possible for a greater fixing force F to be chosen than in the prior art, wherein the fixing force acts via the injector modules (cf. FIG. 4). The use of a higher fixing force F thus enables an improved sealing effect to be achieved at the sealing washer 5 between the injector 1 and the cylinder head 6. At the same time the flexibility is increased even further by the use of the thread as a first bracing contact 13. According to the invention, the fixing force F is directed past the injector modules in this case.

Figure 2:
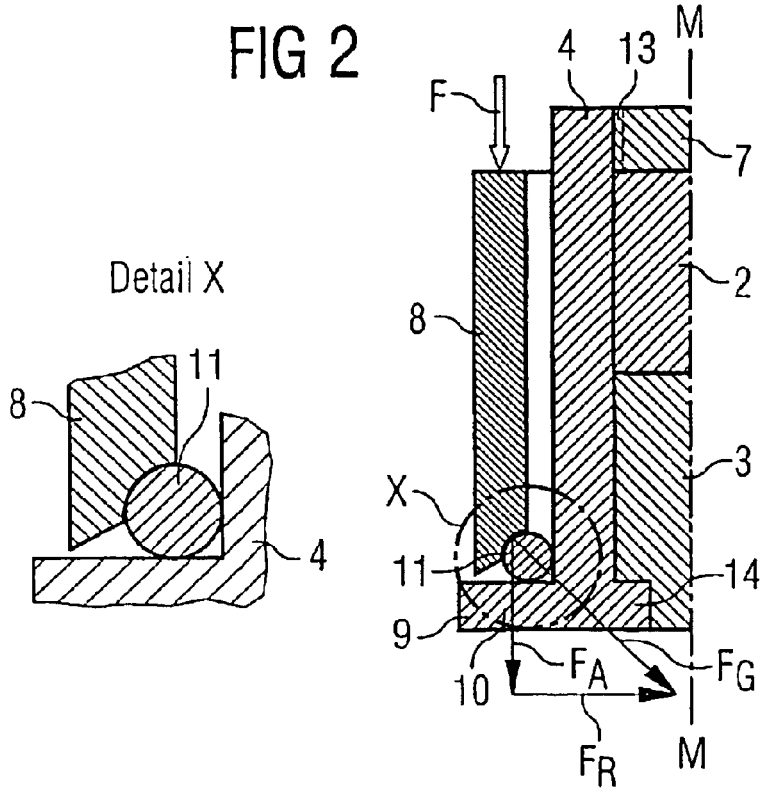
FIG. 2 shows a schematic sectional view of a fixing arrangement according to a second exemplary embodiment of the present invention.

FIG. 2 shows a fixing arrangement according to a second exemplary embodiment of the present invention. In this depiction identical or functionally identical parts are designated by the same reference characters as in the first exemplary embodiment.

As shown in FIG. 2, in contrast to the first exemplary embodiment a slotted embossing ring 11 is disposed between the sleeve 8 and the nozzle nut 4. The fixing force F is thus transmitted via the sleeve 8 and the embossing ring 11 onto the collar 9 of the nozzle tensioning nut 4 and then onto the sealing areas between the injector 1 and the cylinder head.

The use of the embossing ring 11 produces a resulting introduction of force $F_G$ onto the nozzle tensioning nut 4, which force is composed of an axial force $F_A$ and a radial force $F_R$. In order to keep the radial force component $F_R$ to an absolute minimum here, the contact area between the sleeve 8 and the embossing ring 11 is embodied in such a way that, as shown in detail X in FIG. 2, the sleeve 8 matches the outer contour of the embossing ring 11. In order to obtain the smallest possible radial force components here, the cross-section of the embossing ring is preferably circular or oval. It should be noted that the connecting area between the sleeve 8 and the embossing ring 11 can also be embodied as a bevel. As in the first exemplary embodiment, a greater fixing force can be utilized by means of the arrangement according to the invention for introducing the fixing force F at a lower end area 10 of the nozzle tensioning nut 4 and in this way an improved sealing of the injector 1 on the cylinder head 6 can be achieved.

A fixing arrangement according to a third exemplary embodiment of the present invention will be described in the following with reference to FIG. 3. In this depiction identical or functionally identical parts are designated by the same reference characters as in the two preceding exemplary embodiments.

Figure 3:
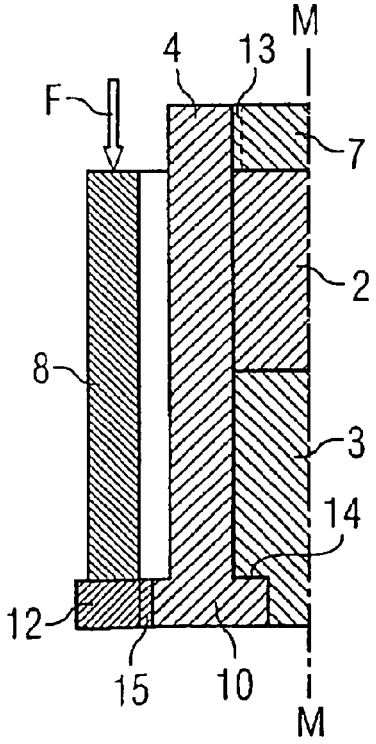
FIG. 3 shows a schematic sectional view of a fixing arrangement according to a third exemplary embodiment of the present invention.

As shown in FIG. 3, in the third exemplary embodiment a nut 12 is provided in place of a collar on the exterior face of the nozzle tensioning nut, said nut 12 being screwed onto an external thread 15 at the lower end area 10 of the nozzle tensioning nut 4. In this case the nut 12 assumes the function of the collar 9 in the preceding exemplary embodiments. The fixing force F is thus transmitted via the sleeve 8 and the nut 12 across the lower area of the nozzle tensioning nut 4 onto the sealing surfaces. Compared with the two preceding exemplary embodiments, in the third exemplary embodiment an assembly-related advantage in particular is produced to the extent that the sleeve 8 does not have to be inserted already during the assembly of the injector 1, but can also be inserted after the assembly of the injector. Following this, the nut 12 is then screwed onto the external thread 15 on the nozzle tensioning nut 4.

It should be noted that in all the above described exemplary embodiments the fixing force F is generated for example by means of a claw which is fixed to the cylinder head 6.

The nut 12 can be embodied for example as a grooved nut which has cutouts on its supporting surfaces so that it can be screwed on by means of a special tool. In this way it is possible to prevent the introduction of too great radial forces that might take place if a normal nut were to be used.

The present invention therefore relates to a fixing arrangement for mounting an injector 1 on a cylinder head 6. The injector 1 has a plurality of injector modules 7, 2, 3 disposed in sequence in the axial direction which are braced against one another by means of a pretensioning element 4. A fixing force F for mounting the injector 1 acts on the pretensioning element 4 in order to prevent disadvantageous force effects on the injector modules.

The present invention is not limited to the exemplary embodiments described. Different variations and modifications can be executed without leaving the scope of the invention.

I claim:

1. A method for mounting an injector on a cylinder head, said injector having a plurality of injector modules disposed in sequence in an axial direction, said method comprising:

bracing the modules against one another by means of a pretensioning element; and applying a direct or indirect fixing force to the pretensioning element for mounting the injector on the cylinder head, wherein the fixing force is applied via a sleeve component and a ring-shaped element is disposed between the pretensioning element and the sleeve component.

2. A method according to claim 1, wherein the fixing force is introduced into the pretensioning element after a first bracing contact between the pretensioning element and an injector module.

3. A method according to claim 1, wherein the sleeve component acts upon a collar on the pretensioning element.

4. A method according to claim 3, wherein the collar is disposed at a lower end area of the pretensioning element closest to the cylinder head.

5. A method according to claim 1, wherein the ring-shaped element has a circular or oval cross-section.

6. A method according to claim 1, wherein the ring-shaped element comprises a nut which is screwed onto an external thread on the pretensioning element.

7. A method according to claim 6, wherein the external thread is disposed at a lower end area of the pretensioning element.

8. A method according to claim 1, wherein the pretensioning element comprises a nozzle tensioning nut, with a first bracing contact being made via a thread.

9. A method according to claim 1, wherein the fixing force is applied by at least one claw fixed to the cylinder head.

10. A mounting arrangement for mounting an injector on a cylinder head, said arrangement comprising:

a pretensioning element for bracing a number of injector modules against one another;

a sleeve component for applying a force to the pretensioning element in the direction of the cylinder head; and a ring-shaped element adapted for positioning between the pretensioning element and the sleeve component.

11. A mounting arrangement according to claim 10, wherein the pretensioning element comprises a collar adapted for contacting the sleeve component.

12. A mounting arrangement according to claim 10, wherein the ring-shaped element has a circular or oval cross section.

13. A mounting arrangement according to claim 10, wherein the ring-shaped element comprises a nut for screwing into an external thread on the pretensioning element.

14. A mounting arrangement according to claim 13, wherein the external thread is located at the end of the pretensioning element closest to the cylinder head.

15. A mounting arrangement according to claim 10, wherein the pretensioning element comprises a nozzle tensioning nut.

16. A mounting arrangement according to claim 10, further comprising at least one claw attached to the cylinder head for facilitating the application of a force.

17. A mounting arrangement according to claim 15, wherein a first bracing contact between the end of the pretensioning element positioned farthest from the cylinder head and an injector module is made via a thread.

18. A mounting arrangement according to claim 17, wherein the thread is adapted to provide flexibility to the pretensioning element.

19. A method for mounting an injector on a cylinder head, said injector having a plurality of injector modules disposed in sequence in an axial direction, said method comprising:

bracing the modules against one another with a tensioning nut, and applying a fixing force to the tensioning nut for mounting the injector on the cylinder head, wherein the fixing force is applied via a sleeve not in contact with the cylinder head.

20. A mounting arrangement for mounting an injector on a cylinder head, said arrangement comprising:

a tensioning nut to brace a number of injector modules against one another, said nut having a collar located on one end; and a sleeve to apply a force to the collar of the nut in the direction of the cylinder head, said sleeve not in contact with the cylinder head.

* * * * *